United States Patent [19]

Chida et al.

[11] Patent Number: 4,859,119

[45] Date of Patent: Aug. 22, 1989

[54] LIQUID CHEMICAL GROUTING APPARATUS AND VALVE SWITCHING ARRANGEMENT IN CONDUIT SYSTEM FOR SUPPLYING LIQUID CHEMICALS TO THE APPARATUS

[75] Inventors: Shouhei Chida, No.5-10, Matsuba 3-chome, Ryugasaki-shi, Ibaragi-ken; Naoki Yamaoto, Tokyo; Yasuo Miyazaki; Yasunori Sato, both of Osaka, all of Japan

[73] Assignees: Nittoc Constructions Co., Ltd., Tokyo; Osaka Bousui Constructions Co., Ltd.; Kashiyama Kogyo Co. Ltd., both of Osaka; Shouhei Chida, Ibaragi, all of Japan

[21] Appl. No.: 162,873

[22] Filed: Mar. 2, 1988

[30] Foreign Application Priority Data

Apr. 10, 1987 [JP] Japan ..... 62-87949

[51] Int. Cl.[4] ..... E02D 3/12

[52] U.S. Cl. ..... 405/269; 405/263; 405/267

[58] Field of Search ..... 405/269, 239–243, 405/263, 258, 303, 266, 233

[56] References Cited

U.S. PATENT DOCUMENTS 4,302,132 11/1981 Ogana et al. ..... 405/266 X
4,449,856 5/1984 Tokora et al. ..... 405/269
4,624,606 11/1986 Nakanishi et al. ..... 405/237 X
4,725,169 2/1988 Tazawa et al. ..... 405/303 X

FOREIGN PATENT DOCUMENTS 0065623 5/1980 Japan ..... 405/269
0083725 5/1983 Japan ..... 405/269

*Primary Examiner*—Dennis L. Taylor
*Attorney, Agent, or Firm*—Felfe & Lynch

[57] ABSTRACT

A grouting rod is formed with a first channel, a second channel (or channels) surrounding the first channel and a third channel which is normally in communication with the first channel. A piston valve is vertically movably received in an upper portion of the third channel. When the piston valve is raised, upper lateral communication holes and upper discharge holes which are formed in the upper peripheral wall of the third channel are closed by the piston valve and concurrently the second channels are permitted to communicate with a lower portion of the third channel through lower lateral communication holes also formed in the upper peripheral wall of the third channel. When the piston valve is lowered, the upper lateral communication holes and upper discharge holes are opened and concurrently the second channel(or channels) is prevented from communicating with the lower portion of the third channel through the lower lateral communication holes.

9 Claims, 13 Drawing Sheets

LIQUID CHEMICAL GROUTING APPARATUS AND VALVE SWITCHING ARRANGEMENT IN CONDUIT SYSTEM FOR SUPPLYING LIQUID CHEMICALS TO THE APPARATUS

BACKGROUND OF THE INVENTION

This invention relates to a liquid chemical grouting apparatus for grouting liquid chemicals into the ground to improve the same and a valve switching arrangement in a conduit system for supplying liquid chemicals to the apparatus.

In the past, as this type of liquid chemical grouting apparatus, an apparatus has been known which is devised by one of the inventors of the present invention and disclosed in Japanese Patent Publication No. 60-3576.

In the prior art apparatus, an outer pipe has, at its tip end, a boring cutter and an inner pipe is disposed in the outer pipe so as to be spaced from the outer pipe. The inner pipe has, near its tip end, an annular wall which blocks the space and which are formed with first and second holes at predetermined circumferential intervals. Formed in the outer pipe is a discharge hole which is normally in communication with the first hole. A piston valve urged to be normally raised by means of a spring is received in the inner pipe near its tip end. When the piston valve is raised, the first hole is closed by the piston valve and concurrently the second hole is opened to permit the space to communicate with an opening at the tip end of the outer pipe. When the piston valve is lowered, the first hole is opened to communicate with the interior of the inner pipe and at the same time the second hole is opened to permit the space to communicate with the interior of the inner pipe.

With the piston valve raised, when a fluid component is supplied to the space between the inner and outer pipes, the fluid component flows into the opening at the tip end of the outer pipe through the second hole and when fluid components are respectively supplied to the space between the inner and outer pipes and to the inner pipe, one fluid component supplied to the inner pipe acts to lower the piston valve by its liquid pressure, permitting the other fluid component supplied to the space between the inner and outer pipes to flow into the inner pipe through the second hole and mix with the one fluid component, and a mixed fluid component is injected to the outside through the first hole and discharge hole.

Conversely, with the piston valve lowered, when the supply of the fluid component to the inner pipe is stopped, the piston valve is permitted to return to its raised position under the influence of only upward force of the spring. During this operation, a hydrostatic pressure prevailing in the inner pipe and sliding resistance exert on the piston valve and therefore the spring is disadvantageously required to have a large spring force which can overcome the above exerting force. Further, in order to lower the piston valve in opposition to the large spring force, the fluid component must be supplied at a large pressure, raising a problem that the supplied fluid component tends to leak, and a countermeasure for prevention of leakage has to be taken.

SUMMARY OF THE INVENTION

A major object of this invention is to obviate the above disadvantages of the prior art apparatus and to provide a liquid chemical grouting apparatus which can actuate a piston valve by using a small spring force.

A second object of this invention is to provide a liquid chemical grouting apparatus which can prevent a defective operation of a spring due to adhesion of grouting material to the spring.

A third object of this invention is to provide a valve switching arrangement which can smoothly switch valves in a conduit system for supplying liquid chemicals to the liquid chemical grouting apparatus.

According to the invention, the above major object can be accomplished by a liquid chemical grouting apparatus comprising: a grouting rod having, at its lower end, a boring cutter; a first longitudinal channel formed in the grouting rod and having an opened upper end; a second longitudinal channel (or channels) formed in the grouting rod to surround the first longitudinal channel and having an opened upper end; a third longitudinal channel formed in a lower major portion of the grouting rod, the third longitudinal channel being normally in communication with the first channel and having an outlet near the lower end of the grouting rod; upper lateral communication holes, lower lateral communication holes and upper discharge holes which are formed in the upper peripheral wall of the third channel, the upper and lower lateral communication holes being vertically spaced apart from each other and through which the second channel (or channels) communicates with the third channel the upper discharge holes being flush with the upper communication holes; a piston valve vertically movably received in an upper portion of the third channel and having a piston upwardly of the lower communication holes, the piston valve being urged to be normally raised by means of a spring, whereby when the piston valve is raised, the upper communication holes and upper discharge holes are closed by the piston and concurrently the second channel (or channels) is permitted to communicate with a lower portion of the third channel through the lower communication holes and when the piston valve is lowered, the upper communication holes and upper discharge holes are opened and concurrently the second channel (or channels) is prevented from communicating with the lower portion of the third channel through the lower communication holes.

With the piston valve raised, when a fluid component is supplied to the second channel (or channels), the fluid component flows into the lower portion of the third channel through the lower communication holes and it is then injected to the outside and when fluid components are supplied to the first channel and second channel (or channels), one fluid component supplied to the first channel flows into the upper portion of the third channel and its supply pressure exerts on the top of the piston to lower the piston valve, permitting the other fluid component supplied to the second channel (or channels) to flow into the third channel through the upper communication holes and mix with the one fluid component, and a mixed fluid component is injected to the outside through the upper discharge holes. When the supply of the fluid component to the first channel is stopped and only the supply of the fluid component to the second channel (or channels) is permitted, the latter fluid component flows into the upper portion of the third channel through the lower communication holes and its supply pressure exerts on the bottom of the piston to cooperate with the spring force so as to raise the piston valve, whereby the upper communication holes and upper discharge holes are closed by the piston and concurrently therewith, the fluid component supplied to the second channel (or channels) flows into the lower portion of the third channel through the lower communication holes and upper portion of the third channel and it is then injected to the outside.

As described above, according to the invention, when the piston valve received in the third channel returns from the lowered position to the raised position, the force of the spring for upwardly urging the piston valve cooperates with the supply pressure, acting on the bottom of the piston, of the fluid component drawn from the second channel (or channels) to the upper portion of the third channel through the lower communication holes to produce a recovery force which is sufficient to raise the piston valve even when the spring force is relatively small. This means that the supply pressure of the fluid component can be small for lowering the piston valve and any countermeasure for prevention of leakage is not needed, thus reducing the manufacture cost of the apparatus.

According to the invention, the second object can be accomplished by a liquid chemical grouting apparatus wherein a rod of the piston valve is formed with upper lateral holes, lower lateral holes and a longitudinal hole which is in communication with the upper and lower lateral holes, and the upper and lower lateral holes and the longitudinal hole substantially set up a channel through which the second channel (or channels) communicates with the lower portion of the third channel.

Thus, with this apparatus, the fluid component flows through the upper and lower lateral holes and longitudinal hole and never adheres to the spring surrounding the rod, thereby preventing occurrence of a defective operation of the spring.

According to the invention, the third object can be accomplished by a valve switching arrangement for use with a liquid chemical grouting apparatus having a grouting rod, the switching arrangement comprising: first and second conduits for respectively supplying setting components and a main component to the grouting rod; two branch conduits connected in common to the upstream side of the first conduit through a first transfer valve, for selectively supplying an instantly setting component and a gradually setting component to the first conduit; a communication conduit having one end connected to the downstream side of the first transfer valve of the first conduit through a second transfer valve and the other end connected to the second conduit, wherein the first and second transfer valves are respectively interlocked with first and second follower gears surrounding, at angular intervals of 90°, a main gear which is fixed on a lever shaft and only the semi-circular half of which is toothed, each of the first and second follower gears being engageable with the maingear and having the diameter which is half the diameter of the main gear.

With this arrangement, as the main gear is rotated every 90° by rotating the lever shaft, the first and second transfer valves respectively interlocked with the first and second follower gears can be switched to the necessary positions at a time, thus simplifying the valve switching operation.

DESCRIPTION OF THE PREFERRED EMBODIMENTS

Figure 1:
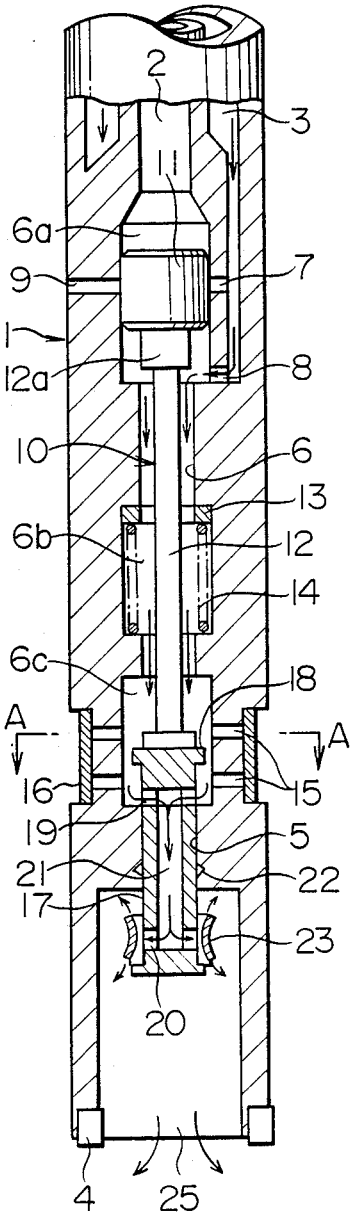
FIG. 1 is a fragmentary, longitudinally sectioned front view illustrating a grouting rod according to an embodiment of the invention, particularly, to show the state during boring.

Referring now to FIGS. 1 to 6, a grouting rod generally designated at 1 and having, at its lower end, a boring cutter 4 is formed with a first longitudinal channel 2 having an opened upper end and second longitudinal channels 3 surrounding the first longitudinal channel 2 and each having an opened upper end. Formed in a lower major portion of the rod 1 is a third longitudinal channel 6 which is normally in communication with the first channel 2 and has an outlet 5 near the lower end of the rod 1. The third channel 6 is comprised of an upper, first chamber 6*a*, an intermediate, second chamber 6*b* and a lower, third chamber 6*c*.

Formed in the peripheral wall of the first chamber 6*a* are vertically spaced upper lateral communication holes 7 and lower lateral communication holes 8 through which the second channels 3 communicate with the first chamber 6*a* and upper discharge holes 9 which are flush with the upper communication holes 7. A first piston valve 10 is supported vertically movably inside the third channel 6, having a piston 11 which is received in the first chamber 6*a* upwardly of the lower communication holes 8 so as to be slidable along the peripheral wall of the first chamber 6*a* and a rod 12 which extends downwards from the piston 11 with its lower end reaching the third chamber 6*c*. The top of the rod 12 merges into a large-diameter portion 12*a* which can come into slidable contact with the peripheral wall of the third channel 6 between the first and second chambers 6*a* and 6*b*. Disposed between the bottom wall of the second chamber 6*b* and a support ring 13 secured to the rod 12 is a spring 14 which urges the first piston valve 10 to be normally raised.

Figure 2:
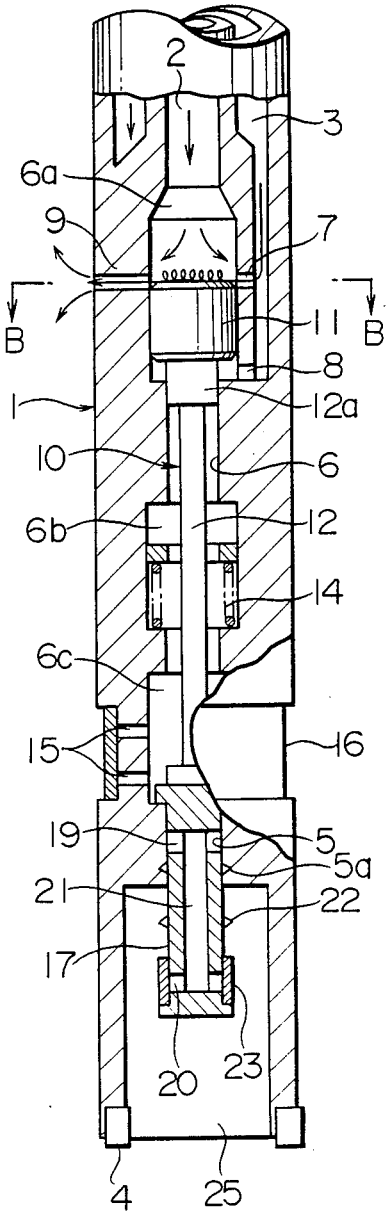
FIG. 2 is a fragmentary, longitudinally sectioned front view illustrating the FIG. 1 grouting rod, particularly, to show the state during injection of the instantly setting grouting fluid.
Figure 3:
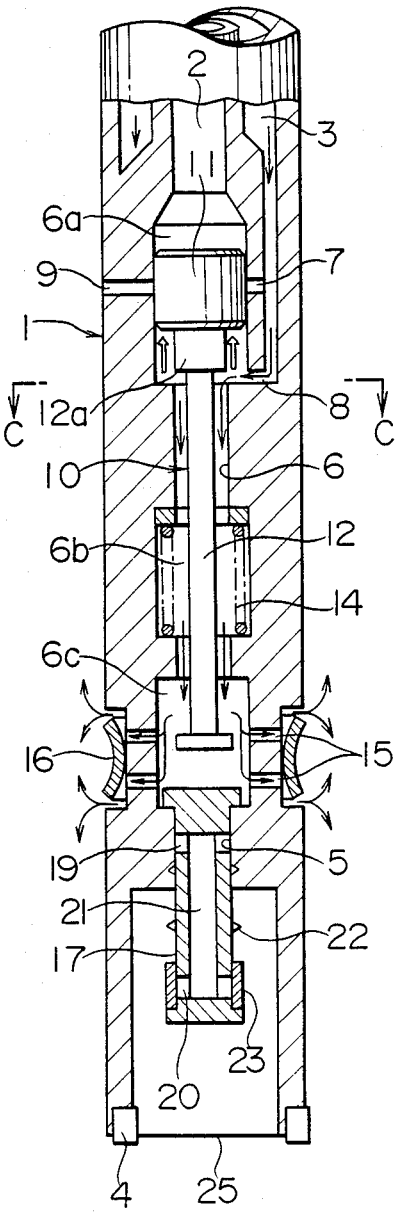
FIG. 3 is a fragmentary, longitudinally sectioned front view illustrating the FIG. 1 grouting rod, particularly, to show the state during injection of the gradually setting grouting fluid.
Figure 4:
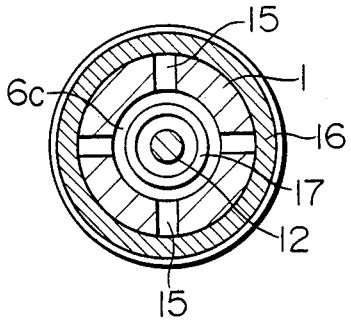
FIG. 4 is a crosssectional view taken on the line A—A of FIG. 1.
Figure 5:
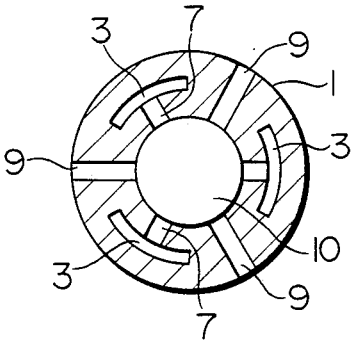
FIG. 5 is a crosssectional view taken on the line B—B of FIG. 2.
Figure 6:
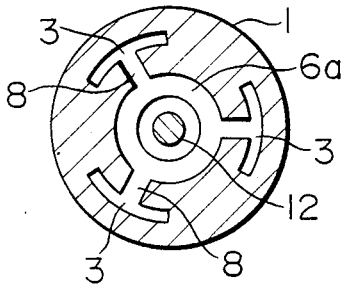
FIG. 6 is a crosssectional view taken on the line C—C of FIG. 3.

With the first piston valve 10 raised, the upper communication holes 7 and upper discharge holes 9 are closed by the piston 11 and concurrently the large-diameter portion 12*a* of the rod 12 disengages from the peripheral wall of the third channel 6, thereby permitting the second channels 3 to communicate with the lower chamber of third channel 6, i.e., the third chamber 6*c* through the lower communication holes 8 (FIGS. 1 and 3). Conversely, with the first piston valve 10 lowered, the upper communication holes 7 and upper discharge holes 9 are opened and concurrently the large-diameter portion 12*a* of the rod 12 is brought into slidable contact with the peripheral wall of the third channel 6 to block the third channel 6, with the result that the second channels 3 are prevented from communicating with the third chamber 6*c* through the lower communication holes 8 (FIG. 2).

Formed in the peripheral wall of the third chamber 6*c* are lower discharge holes 15 which are surrounded by an annular resilient valve 16 made of, for example, rubber. Slidably mounted in the outlet 5 below the third chamber 6*c* is a second piston valve 17 having its upper end protruding into the third chamber 6*c* and its lower end downwardly extending beyond the outlet 5, the upper end having a flange 18 which can rest on the bottom wall of the third chamber. The second piston valve 17 is formed with upper lateral holes 19 and lower lateral holes 20 and a longitudinal hole 21 which is in communication with the lateral holes 19 and 20. When the second piston valve 17 is raised with a stop spring 22 provided on its periphery snugged in a recess 5*a* in the peripheral wall of the outlet 5, the upper lateral holes 19 open to the third chamber 6*c* (FIG. 1). When the second piston valve 17 is lowered with the stop spring 22 separating from the outlet 5, the upper lateral holes 19 are closed (FIGS. 2 and 3). The lower lateral holes 20 are surrounded by an annular resilient valve 23.

With the grouting rod described as above, the work for boring the ground 39 to form a hole 40 (FIG. 7) and injecting liquid chemicals into the ground is performed as will be described below.

Figure 7:
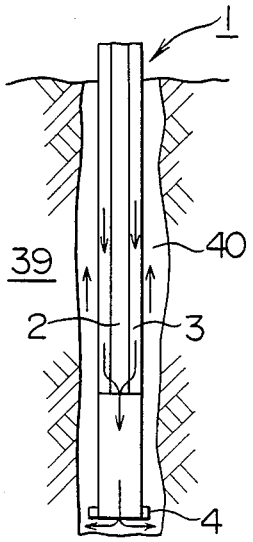
FIGS. 7 to 10 are schematic diagrams showing the sequence of operation through the use of the FIG. 1 grouting rod.

1. Boring Operation (FIGS. 1 and 7)

Prior to the commencement of boring, a bar, not shown, is inserted into a tip (lower) and opening 25 of the grouting rod 1 so that the second piston valve 17 may be pushed upwards to bring the stop spring 22 into engagement with the recess 5*a* in the peripheral wall of the outlet 5, thereby keeping the second piston valve 17 raised as shown in FIG. 1.

Boring water is then supplied to the second channels 3 and the ground 39 is bored while the grouting rod 1 being rotated, in the same manner as the conventional boring process.

During this operation, the boring water supplied to the second channels 3 first flows into the third channel 6 through the lowercommunication holes 8, then it flows into the third chamber 6*c* and flows through the holes 19 and 20 formed in the second piston valve 17 whereupon the resilient valve 23 can be stretched out by a liquid pressure, and finally it is discharged into the hole 40 through the tip end opening 25 of the rod 1. In this way, the hole 40 of a predetermined depth can be bored as illustrated in FIG. 7. Since the resilient valve 23 plays the role of a check valve, soil and sand will not be drawn into the rod 1 even when the counter water pressure is high. By designing the resilient valve 23 so as to be actuated at a pressure which is lower than that for the resilient valve 16, the boring water can be prevented from being discharged through the lower discharge holes.

Figure 8:
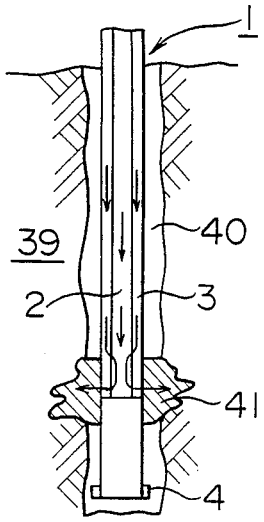

2. Injection of Instantly Setting Grouting Fluid (FIGS. 2 and 8)

When the boring of the hole 40 is completed in the manner described previously, the supply of water to the second channels 3 is stopped and an instantly setting component is supplied to the first channel 2 simultaneously with supply of a main component such as water glass to the second channels 3.

Under this condition, a pressure of the supplied liquid exerting on the first piston valve 10 from the above lowers the firsts piston valve 10 in opposition to upward force of the spring 14, as illustrated in FIG. 2, and consequently the piston 11 permits the upper communication holes 7 and upper discharge holes 9 to be opened and at the same time the large-diameter portion 12*a* of the rod 12 is brought into slidable contact with the peripheral wall of the third channel 6 to block the flow from the second channels 3 to the third chamber 6*c* through the lower communication holes 8.

Thus, the main component flowing from the second channels 3 to the first chamber 6*a* of the third channel 6 through the upper communication holes 7 and the instantly setting component prevailing in the first chamber 6*a* are mixed together in the cavity above the first piston valve 10 to prepare an instantly setting grouting fluid. The thus prepared instantly setting grouting fluid is injected into the hole 40 through the upper discharge holes 9 and part of the injected fluid permeates the wall of the hole 40 and hardens within a short period of time, thus forming a packer 41 in the hole 40, as shown in FIG. 8.

Since the second piston valve 17 is also lowered by the lowering of the first piston valve 10, the upper lateral holes 19 are closed.

Figure 9:
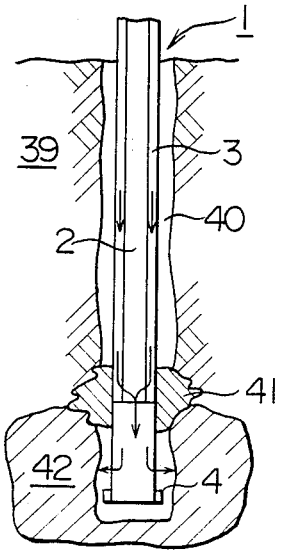

3. Injection of Gradually Setting Grouting Fluid (FIGS. 3 and 9)

When the packer 41 has been formed in the previously-described manner, the supply of the instantly setting component to the first channel 2 is stopped and the main component and a gradually setting component are supplied to only the second channels 3, these components being mixed together in advance in the conduit system to be described later to prepare a gradually setting grouting fluid.

The thus prepared gradually setting grouting fluid flows through the lower communication holes 8 into the first chamber 6*a* where a liquid pressure of the supplied fluid exerts on the bottom of the piston 11 of the first piston valve 10. As a result, the liquid pressure cooperates with the upward force of the spring 14 to return the first piston valve 10, so that the valve 10 recovers its original position and closes the upper communication holes 7 and upper discharge holes 9. Accordingly, the gradually setting grouting fluid supplied to the second channels 3 flows into the third channel 6 through the lower communication holes 8 and then it flows into the third chamber 6*c* to stretch out the resilient valve 16 by its liquid pressure, with the result that the fluid is injected into the hole 40 downwardly of the packer 41 to permeate the wall of the hole, thus producing a gradually setting grouting fluid grouted formation 42 as shown in FIG. 9.

Figure 10:
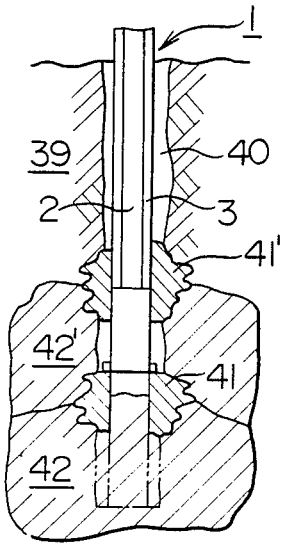

In this way, the fluid grouted formation 42, which is water impermeable and used for strengthening the ground, can be provided at the bottom of the hole 40. However, as shown in FIG. 10, the grouting rod 1 may be raised by a desired height to produce another fluid grouted formation 42' upwardly of the formation 42, as necessary. If so desired, this production of the fluid grouted formation may be repeated by a desired number of frequencies.

Figure 11:
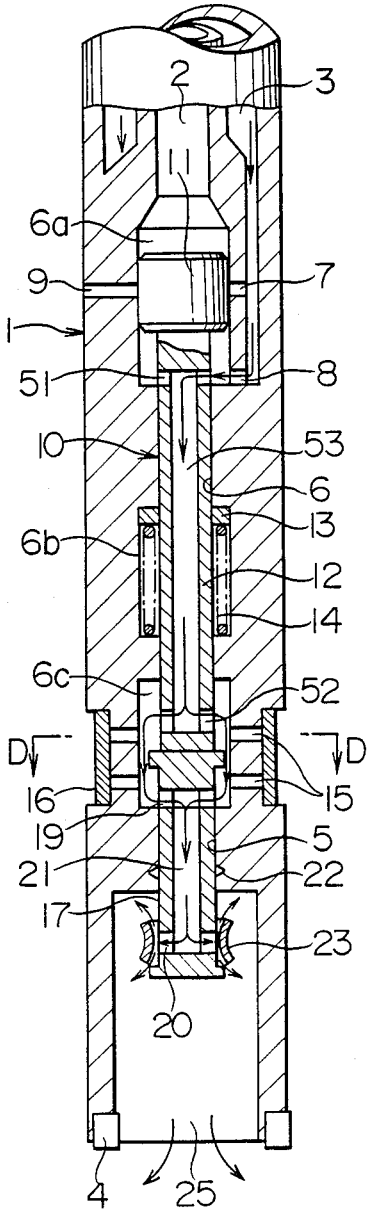
FIG. 11 is a fragmentary, longitudinally sectioned front view illustrating a grouting rod according to another embodiment of the invention, particularly, to show the state during boring.
Figure 12:
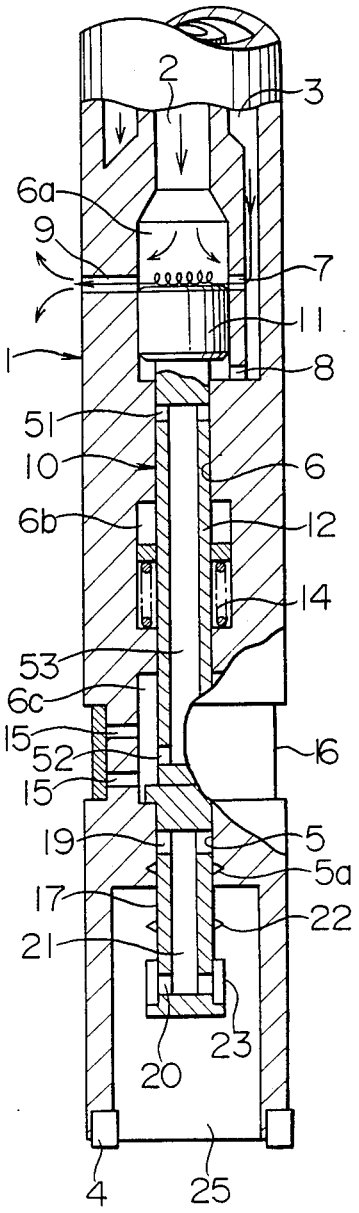
FIG. 12 is a similar view showing the state of the FIG. 11 grouting rod during injection of the instantly setting grouting fluid.
Figure 13:
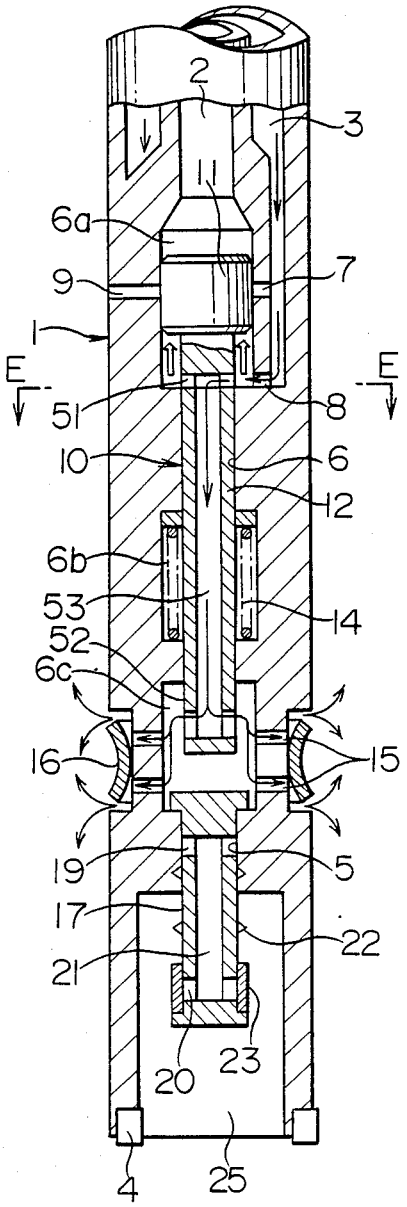
FIG. 13 is a similar view showing the state of the FIG. 11 grouting rod during injection of the gradually setting grouting fluid.
Figure 14:
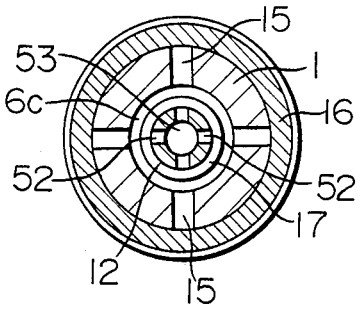
FIG. 14 is a crosssectional view taken on the line D—D of FIG. 11.
Figure 15:
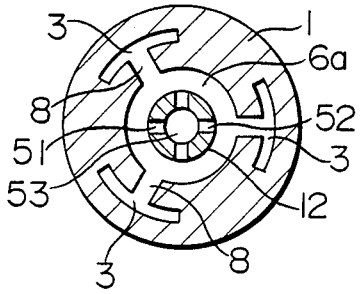
FIG. 15 is a crosssectional view taken on the line E—E of FIG. 13.

Referring to FIGS. 11 to 15, another embodiment of the invention will now be described. In this embodiment, a first piston valve 10 of a rod 12 is normally in slidable contact with the peripheral wall of the third channel 6 between the first and third chambers 6*a* and 6*c*, and the rod 12 is formed with upper lateral holes 51 and lower lateral holes 52 as well as a longitudinal hole 53 which is in communication with the lateral holes 51 and 52. Substantially, these holes 51, 52 and 53 set up a channel through which the second channels 3 communicate with the third chamber 6*c*. Thus, when the first piston valve 10 is raised for the purpose of supplying the boring water or the gradually setting grouting fluid, the upper lateral holes 51 open to the first chamber 6*a* to permit the second channels 3 to communicate with the third chamber 6*c* through the lower communication holes 8 (FIGS. 11 and 13). Conversely, when the first piston valve 10 is lowered for the purpose of supplying the instantly setting grouting fluid, the upper lateral holes 51 are closed to prevent the second channels 3 from communicating with the third chamber 6*c* through the lower communication holes 8 (FIG. 12).

In this embodiment, the first piston valve 10 can also be returned from the lowered position to the raised position under the influence of the liquid pressure exerting on the bottom of the piston 11 and upward force of the spring 14 as in the case of the previous embodiment but advantageously the grouting fluid can flow by passing through the rod 12 without interfering with the spring 14, thereby preventing adhesion of the grouting fluid to the spring 14 which may cause a failure of the operation of the spring 14.

Figure 16:
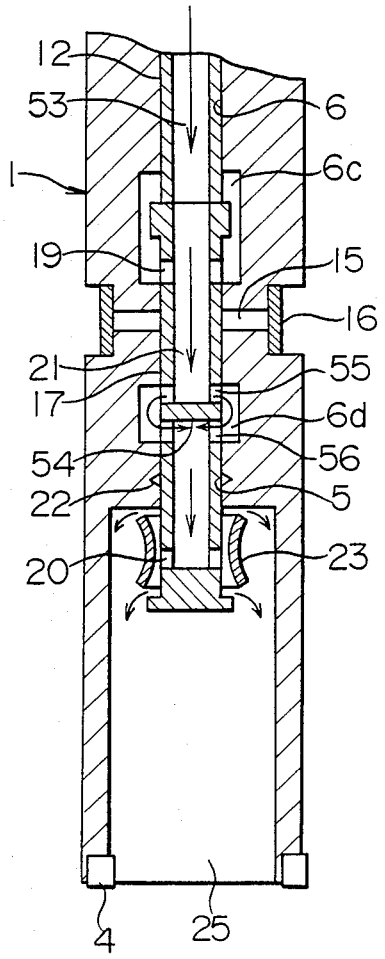
FIG. 16 is a fragmentary, longitudinally sectioned front view illustrating a grouting rod according to still another embodiment of the invention, particularly, to show the state during boring.
Figure 17:
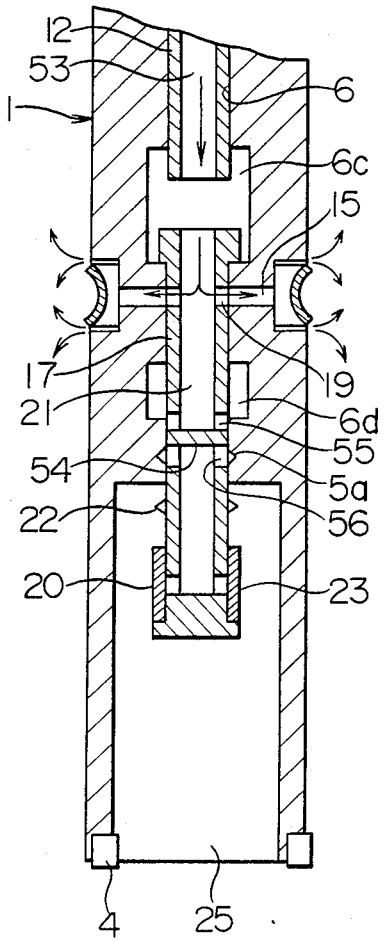
FIG. 17 is a similar view showing the state of the FIG. 16 grouting rod during injection of the gradually setting grouting fluid.

In both of the previously-described embodiments, when the boring water is supplied and passed to the third chamber 6*c* (FIGS. 1 and 11), a small amount of this boring water presumably stretches out the resilient valve 16 and leaks through the lower discharge holes 15. Practically, such leakage of the boring water through the lower discharge holes 15 does not do harm to the operation. But the leakage can be prevented completely in accordance with still another embodiment of the invention as shown in FIGS. 16 and 17. More particularly, in this embodiment, the outlet 5 of the third channel 6 is formed with a fourth chamber 6*d* and lower discharge holes 15 are formed between the third chamber 6*c* and fourth chamber 6*d*. Further, a second piston valve 17 is formed with a longitudinal hole 21 which is partitioned by a mid-plate 54 and upper, intermediate lateral holes 55 and lower, intermediate lateral holes 56 which vertically oppose to each other through the mid-plate 54.

When the second piston valve 17 is raised during supply of the boring water, the upper lateral holes 19 open to the third chamber 6*c* and the intermediate lateral holes 55 and 56 open to the fourth chamber 6*d* and concurrently therewith, the lower discharge holes 15 are closed by the second piston valve 17, ensuring that the boring water can be drawn through the upper lateral holes 19 and intermediate lateral holes 55, 56 and can be injected through the lower lateral holes 20 (FIG. 16). Conversely, when the second piston valve 17 is raised, during the supply of the gradually setting grouting fluid, the upper lateral holes 19 communicate with the lower discharge holes 15 and at the same time the intermediate lateral holes 55, 56 are closed, permitting the gradually setting grouting fluid to be drawn through the upper lateral holes 19 and injected through the lower discharge holes 15 (FIG. 17).

Since in the embodiment shown in FIGS. 16 and 17 the longitudinal hole 21 in the second piston valve 17 serves as a channel used in common for the boring water and the gradually setting grouting fluid, part of the gradually setting injection fluid drawn to the longitudinal hole 21 tends to stagnate and harden between the mid-plate 54 and the upper lateral holes 19 and the thus hardened fluid tends to hinder the flow of the boring water during the succeeding boring, giving rise to a defective operation.

Figure 18:
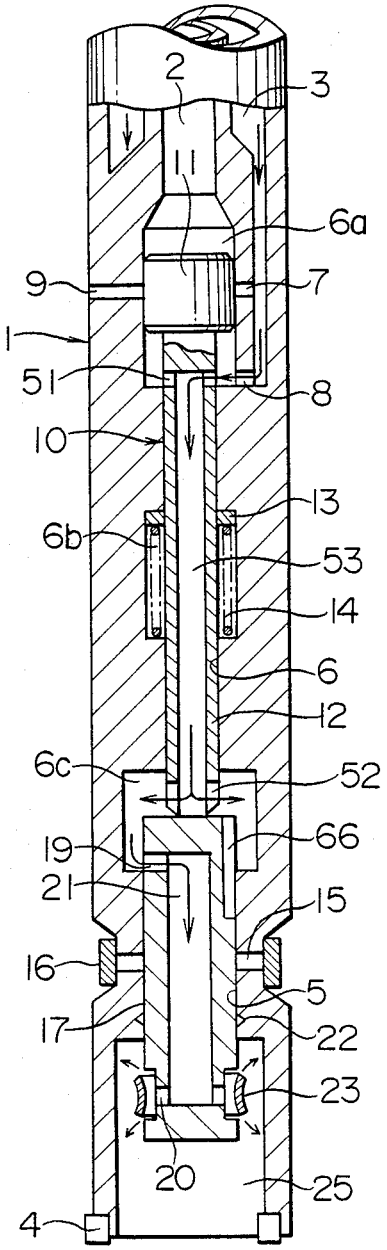
FIG. 18 is a fragmentary, longitudinally sectioned front view illustrating a grouting rod according to yet still another embodiment of the invention, particularly, to show the state during boring.
Figure 19:
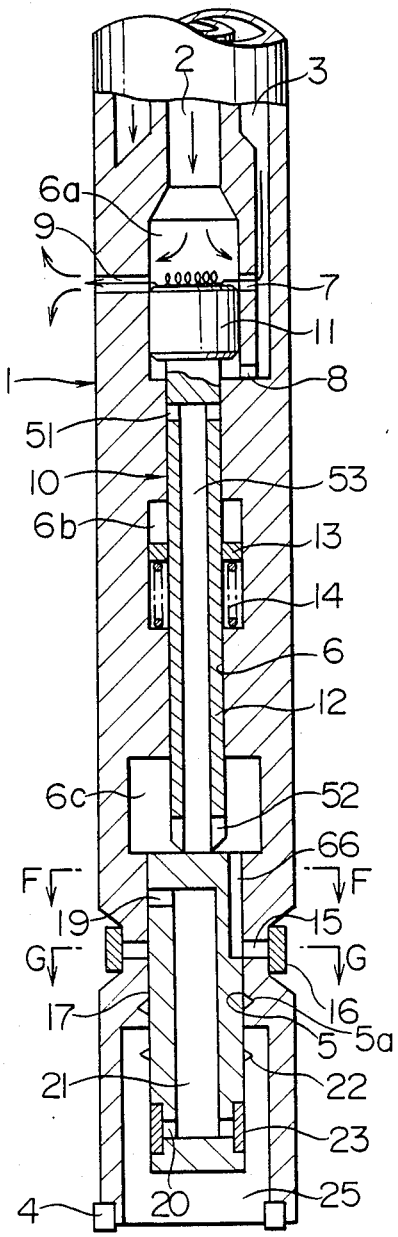
FIG. 19 is a similar view showing the state of the FIG. 18 embodiment during injection of the instantly setting grouting fluid.
Figure 20:
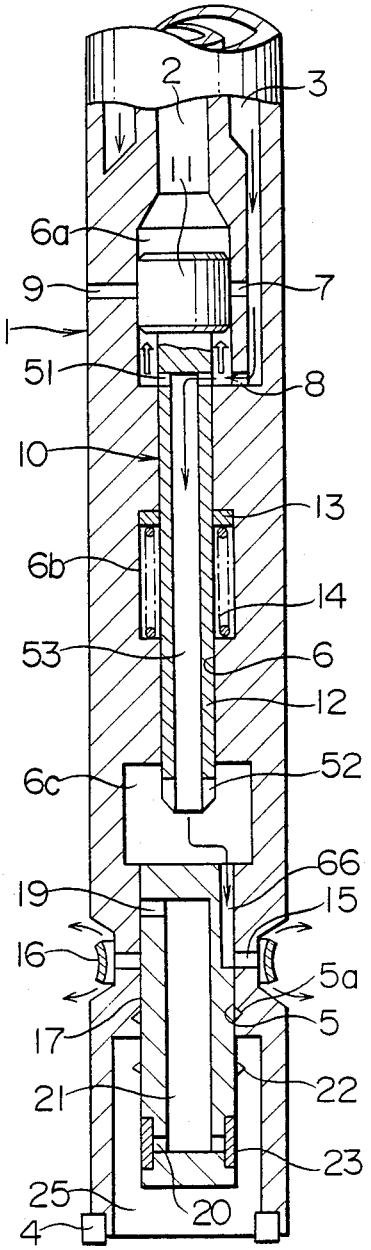
FIG. 20 is a similar view showing the state of the FIG. 18 embodiment during injection of the gradually setting grouting fluid.
Figure 21:
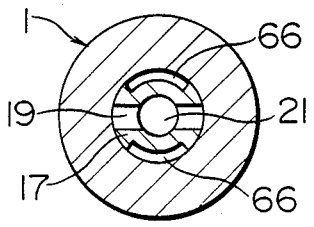
FIG. 21 is a crosssectional view taken on the line F—F of FIG. 19.
Figure 22:
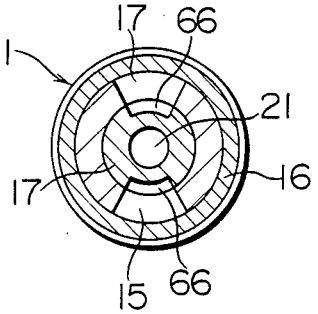
FIG. 22 is a crosssectional view taken on the line G—G of FIG. 19.

A further embodiment of the invention is illustrated in FIGS. 18 to 22 is directed to elimination of the above disadvantage. In this embodiment, lower discharge holes 15 are formed in the peripheral wall of the third channel 6 downwardly of the third chamber 6*c*. A second piston valve 17 is formed with upper lateral holes 19 and lower lateral holes 20 as well as second longitudinal holes 66 which are provided in addition to the first longitudinal hole 21 being in communication with the lateral holes 19 and 20 and which take the form of a groove opened upwardly. When the second piston valve 17 is raised with the stop spring 22 secured to the periphery of the second piston valve 17 snugged in the recess 5*a* in the peripheral wall of the outlet 5, the upper lateral holes 19 open to the third chamber 6c and concurrently the lower discharge holes 15 are closed (FIG. 18). Conversely, when the piston valve 17 is lowered with the stop ring 22 separated from the outlet 5, the upper lateral holes 19 are closed and at the same time the third chamber 6c is permitted to communicate with the lower discharge holes 15 through the second longitudinal holes 66 (FIGS. 19 and 20).

With the second piston valve 17 raised for supplying boring water, the boring water is passed through the upper lateral holes 19 and first longitudinal hole 21 and is then injected through the lower lateral holes 20 (FIG. 18). With the second piston valve 17 lowered for supplying the gradually grouting injection fluid, this fluid is passed through the second longitudinal holes 66 and is then injected through the lower discharge holes 15 (FIG. 20).

Figure 23:
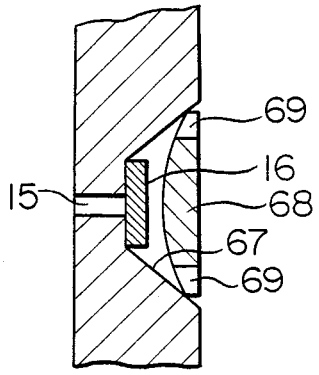
FIGS. 23 and 24 are longitudinally sectioned front views showing a protective mechanism for a resilient valve.
Figure 24:
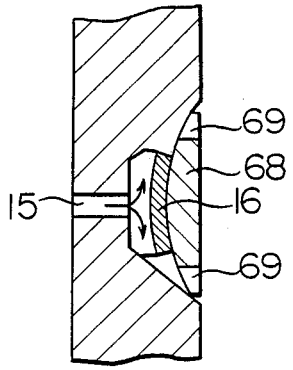
Figure 25:
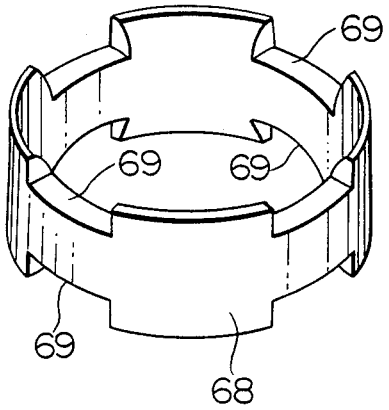
FIG. 25 is a perspective view illustrating a protective band.

The resilient valve 16 for open or close of the lower discharge holes 15 is directly exposed to the outside and tends to be damaged by making direct contact with soil and sand during boring of the hole. To avoid this disadvantage, an annular protective band 68 is mounted in an annular recess 67 in which the resilient valve 16 is received, as shown in FIGS. 23 to 25. The protective band 68 has upper circumferentially spaced cuttings 69 and lower circumferentially spaced cuttings also designated by 69 and when mounted, establishes an inner convex contour surface. With the resilient valve 16 stretched out by the liquid pressure as shown in FIG. 24, the resilient valve 16 abuts against the inner contour surface of the protective band 68 and the gradually setting grouting fluid discharged from the lower discharge holes 15 is injected through the upper and lower cuttings 69.

The previous embodiments are not limitative and are described for illustrative purpose only, and the invention may be modified and altered within the framework of the appended claims by having the same function as described previously. For example, the lower discharge holes 15 and second piston valve 17 may be removed, so that the boring water and gradually setting grouting fluid may both be injected downwards through the outlet 5 of the third channel 6.

However, it is preferable that the gradually setting grouting fluid be injected laterally through the lower discharge holes 15 as in the case of each of the previously-described embodiments. This is because the lateral injection pressure creates a wedge-like crack in the wall of the hole 40 and the grouted fluid permeates the ground directly downwardly of the packer by having lateral directivity, whereby a predetermined region of the ground can be strengthened and water permeability thereat can steadily be lowered.

As the grouting fluid to be supplied, a desired one can be selected from many types of grouting fluid which are conventionally available.

Figure 26:
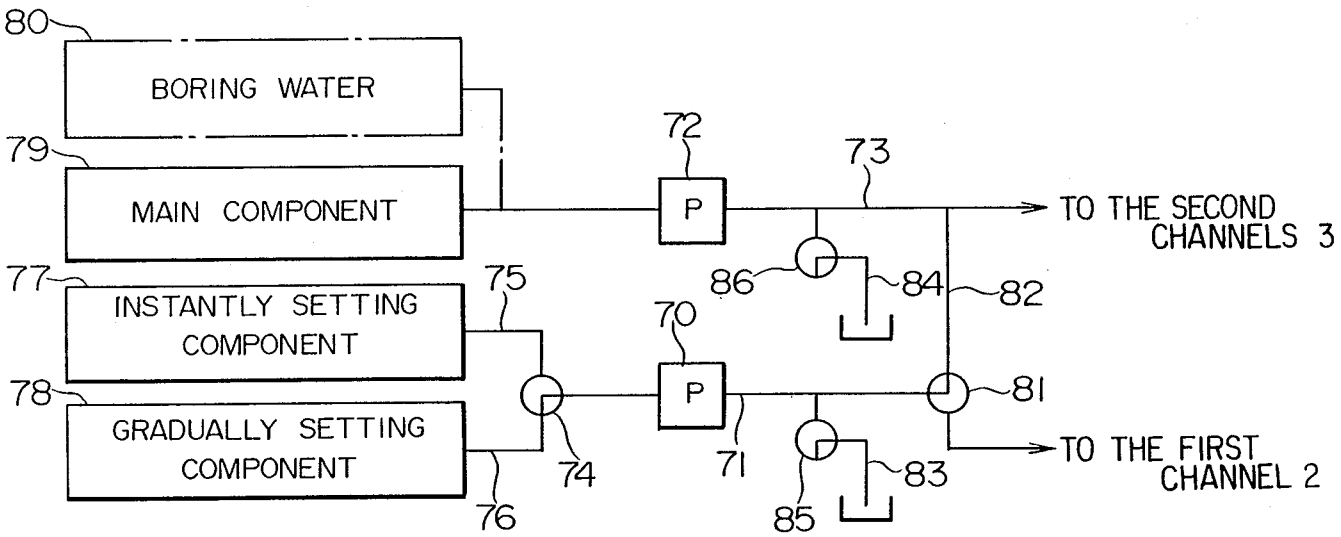
FIG. 26 is a schematic diagram showing a conduit system for supplying fluid components.

FIG. 26 illustrate a conduit system for supplying the various components to the grouting rod 1 wherein a first conduit 71 having a pump 70 is connected to the first channel 2 and a second conduit 73 having a pump 72 is connected to the second channels 3. Two branch conduits 75 and 76 are connected in common to the upstream side of the first conduit 71 through a first transfer valve 74, one branch conduit 75 being connected to an instantly setting component tank 77 and the other 76 to a gradually setting component tank 78. Connected to the upstream side of the second conduit 73 is a main component tank 79. Only when boring water is supplied, a boring water tank 80 is operatively connected to the second conduit 73. A communication conduit 82 has one end connected to the downstream side of the pump 70 of the first conduit 71 through a second transfer valve 81 and the other end connected to the downstream side of the pump 72 of the second conduit 73. Pressure relief conduits 83 and 84 are connected to the first and second conduits 71 and 73 through third and fourth transfer valves 85 and 86, respectively. As the first to fourth transfer valves 74, 81, 85 and 86, bidirectional valves may be used.

FIGS. 27A to 27D show the flow of fluids in the conduit system shown in FIG. 26.

Figure 27A:
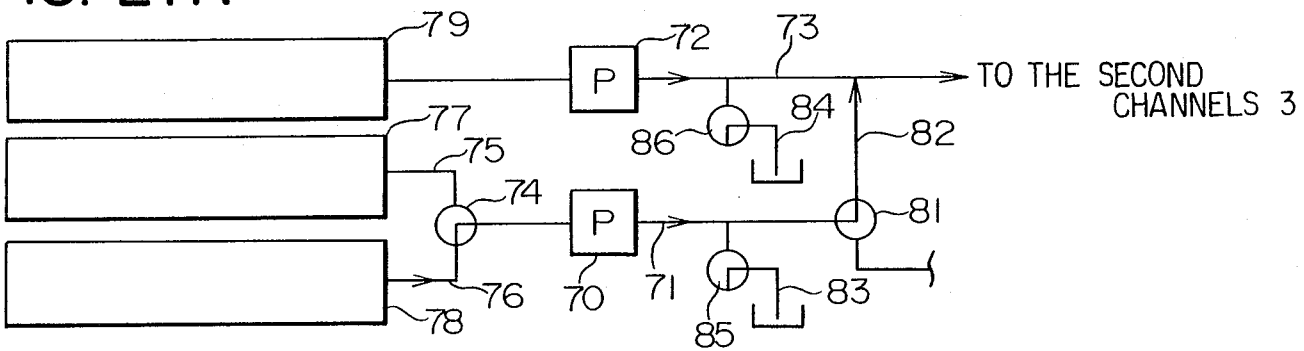
FIGS. 27A to 27D are schematic diagrams showing the sequence of valve switching.

In the supply process of the gradually setting component as illustrated in FIG. 27A, the first transfer valve 74 permits the branch conduit 76 to communicate with the first conduit 71, the second transfer valve 81 permits the first conduit 71 to communicate with the communication conduit 82, and the third and fourth transfer valves 85 and 86 prevent the component from passing through the pressure relief conduits 83 and 84. In this case, the main component flowing through the second conduit 73 is mixed with the gradually setting component flowing through the branch conduit 76, first conduit 71 and communication conduit 82 into the second conduit 73 to prepare the gradually setting grouting fluid which in turn is supplied to the second channels 3.

Figure 27B:
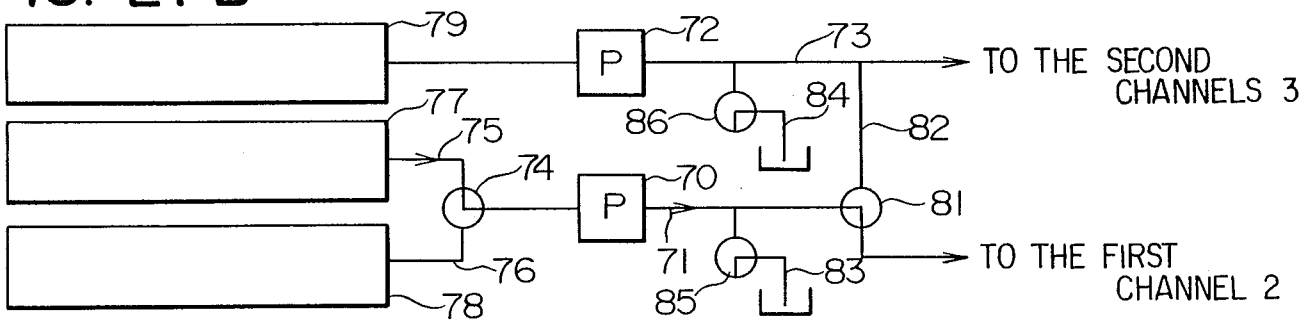

In the supply process of the instantly setting component as illustrated in FIG. 27B, the first transfer valve 74 is transferred to permit the branch conduit 75 to communicate with the first conduit 71, and the second transfer valve 81 is transferred to prevent the first conduit 71 from communicating with the communication conduit 82, thereby permitting the component to flow through only the first conduit 71. In this case, the main component flowing through the second conduit 73 is supplied to the second channels 3 and the instantly setting component flowing through the branch conduit 75 and first conduit 71 is supplied to the first channel 2.

Figure 27C:
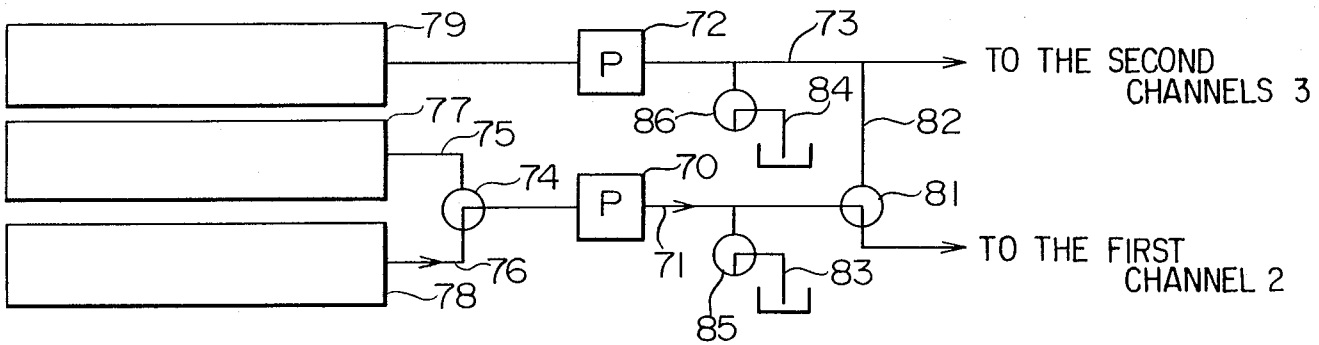

In the process for switching the instantly setting component and gradually setting component as illustrated in FIG. 27C, the first transfer valve 74 is transferred to permit the branch conduit 76 to communicate with the first conduit 71, so that the main component flowing through the second conduit 73 may be supplied to the second channels 3 and the gradually setting component flowing through the branch conduit 76 and first conduit 71 may be supplied to the first channel 2. In this manner, the residue of the instantly setting component staying in the first conduit 71 between the first and second transfer valves 74 and 81 is not permitted to flow into the second channels 3 but is pushed into the first channel 2.

Figure 27D:
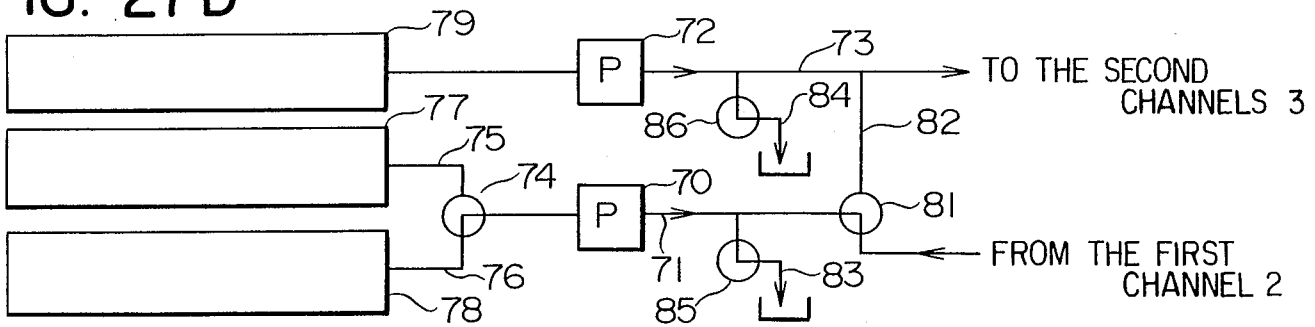
Figure 28:
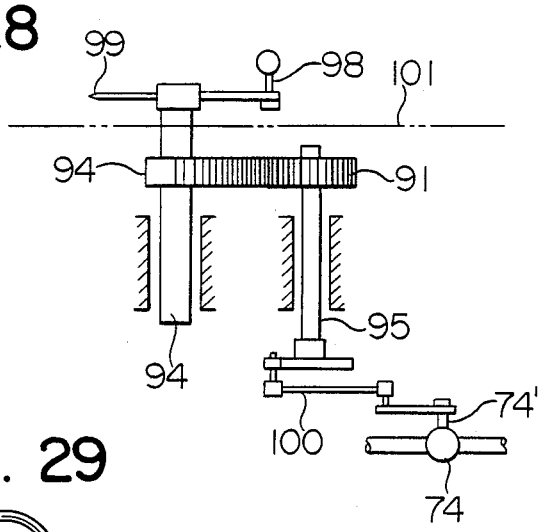
FIG. 28 is a front view illustrating an embodiment of a valve switching arrangement of the invention.
Figure 29:
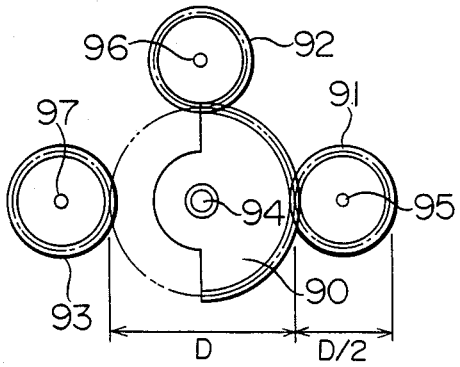
FIG. 29 is a plane view showing a gear train.
Figure 30:
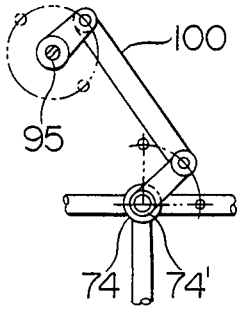
FIG. 30 is a plane view illustrating an interlocking mechanism between a gear and a valve.
Figure 31:
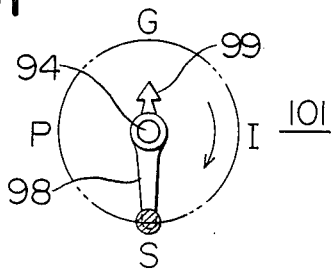
FIG. 31 is a plane view showing a panel.

In the process for relieving pressure in the conduit system as illustrated in FIG. 27D, the third and fourth transfer valves 85 and 86 are transferred to permit the components to pass through the pressure relief conduits 83 and 84, whereby the gradually setting component in the branch conduit 76, first conduit 71 and first channel 2 can be discharged through the pressure relief conduit 83 and the main component in the second conduit 73 and second channels 3 can be discharged through the pressure relief conduit 84. In this manner, the pressure in the grouting rod 1 can be relieved instantaneously to ensure smooth operation of the valves adapted to open or close the discharge holes.

The above processes forms one cycle of operation and are repeated sequentially as the piston valve 10 moves vertically over the predetermined length.

It should be understood that for the supply of boring water, the water tank 80 is operatively connected to the second conduit 73 in the conduit system shown in FIG. 27A.

When one process changes to another, each of the first to fourth transfer valves 74, 81, 85 and 86 can be transferred or switched manually only at the cost of troublesome operation.

FIGS. 28 to 31 illustrates an embodiment of a valve switching arrangement according to the invention by which individual transfer valves can be operated simultaneously for each process.

Referring to FIGS. 28 to 31, a main gear 90, only the semi-circular half of which is toothed, is fixed on a lever shaft 94. The main gear 90 is surrounded by a first follower gear 91, a second follower gear 92 and a third follower gear 93 which are spaced apart from each other at angular intervals of 90° and engageable with the main gear 90. The diameter of each of the first, second and third follower gears 91, 92 and 93 is half the diameter of the main gear 90.

The first follower gear 91 has a shaft 95 which is coupled to a shaft 74' of the first transfer valve 74 through a crank mechanism 100. Consequently, as the main gear 90 in mesh with the first follower gear 91 rotates by ¼ revolution (90 degrees), the first follower gear 91 is forced to rotate by ½ revolution (180 degrees), whereby the valve shaft 74' can be 90° rotated sympathetically through the crack mechanism 100. Subsequently, as the main gear 90 further makes ¼ revolution, the first follower gear 91 is further rotated by ½ revolution, whereby the valve shaft 74' can be 90° rotated in the reverse direction to return the valve 74 to its original position. Although not illustrated, the connection of the second and third follower gears is such that the second follower gear 92 has a shaft 96 coupled to the shaft of the second transfer valve 81 through a crank mechanism and similarly, the third follower gear 93 has a shaft 97 coupled in common to the shafts of the third and fourth transfer valves 85 and 86 through a crank mechanism.

The lever shaft 94 is attached with a lever 98 with a pointer 99 which can indicate any one of four operation processes marked on a panel 101, that is, the supply process of gradually setting grouting fluid (G), the supply process of instantly setting grouting fluid (I), the switching process (S) and the pressure relief process (P).

During operation, the lever 98 is rotated every 90° and in accordance with this rotation, any one of the first to third follower gears 91 to 93 are rotated to effect switching among the first to fourth transfer valves 74, 81, 85 and 86. The switching corresponds to each 90° rotation of the lever as enumerated in the following Table.

| Lever angle | 0° | 90° | 180° | 270° | 360° (0°) |
|---|---|---|---|---|---|
| Operation process | Supply of gradually setting grouting fluid | Supply of instantly setting grouting fluid | Switching of setting components | Pressure relief | Supply of gradually setting grouting fluid |
| Valve 74 | ○ | ◔ | ◔ | ◔ | ◔ |
| Valve 81 | ◔ | ◔ | ◔ | ◔ | ◔ |
| Valves 85, 86 | ◔ | ◔ | ◔ | ◔ | ◔ |

The states of the respective transfer valves 74, 81, 85 and 86 illustrated in the above Table coincide with those shown in FIGS. 27A to 27D, indicating that by rotating the lever 98 every 90°, the respective transfer valves 74, 81, 85 and 86 can be transferred to their necessary positions at a time.

The transfer valve is not limited to the bidirectional type but a tri-directional valve may substitute therefor with elimination of the crank mechanism. The provison of the transfer valves 85 and 86 participating in the pressure relief is not always necessary. Further, because of only one switching of the transfer valves 85 and 86 during one cycle of operation process, these transfer valves may not be interlocked with the follower gear but may be coupled directly to the main gear. Other modifications and alternations of the invention may be possible in various ways.

What is claimed is:

1. A liquid chemical grouting apparatus comprising:

a grouting rod having, at its lower end, a boring cutter;

a first longitudinal channel formed in said grouting rod and having an opened upper end;

a second longitudinal channel formed in said grouting rod to surround said first longitudinal channel and having an opened upper end;

a third longitudinal channel formed in a lower major portion of said grouting rod, said third longitudinal channel being normally in communication with said first channel and having an outlet near the lower end of said grouting rod;

upper lateral communication holes, lower lateral communication holes and upper discharge holes which are formed in the upper peripheral wall of said third channel, said upper and lower lateral communication holes being vertically spaced apart from each other and through which said second channel communicates with said third channel, said upper discharge holes being flush with said upper communication holes;

a piston valve vertically movably received in an upper portion of said third channel and having a piston upwardly of said lower communication holes, said piston valve being urged to be normally raised by means of a spring, whereby when said piston valve is raised, said upper communication holes and upper discharge holes are closed by said piston and concurrently said second channel is permitted to communicate with a lower portion of said third channel through said lower communication holes and when said piston valve is lowered, said upper communication holes and upper discharge holes are opened and concurrently said second channel is prevented from communicating with said lower portion of said third channel through said lower communication holes.

2. A liquid chemical grouting apparatus according to claim 1 wherein said piston valve has a rod extending downwards from said piston.

3. A liquid chemical grouting apparatus according to claim 2 wherein the top of said rod merges into a large-diameter portion which can come into slidable contact with the peripheral wall of said third channel.

4. A liquid chemical grouting apparatus according to claim 2 wherein said rod is formed with upper lateral holes, lower lateral holes and a longitudinal hole which is in communication with said upper and lower lateral holes, said upper and lower lateral holes and said longitudinal hole substantially setting up a channel through which said second channels communicate with said lower portion of said third channel.

5. A liquid chemical grouting apparatus according to claim 1 wherein lower discharge holes are formed in the lower peripheral wall of said third channel, a second piston valve is vertically movably received in said lower portion of said third channel in addition to said first piston valve received in said upper portion of said third channel, said second piston valve being formed with upper lateral holes and a longitudinal hole which is in communication with said upper lateral holes, whereby when said second piston valve is raised, said upper lateral holes of said second piston valve open to said third channel and when said second piston valve is lowered, said upper lateral holes of said second piston valve are closed.

6. A liquid chemical grouting apparatus according to claim 5 wherein when said second piston valve is raised, said lower discharge holes are closed by said second piston valve.

7. A liquid chemical grouting apparatus according to claim 5 wherein said lower discharge holes are surrounded by an annular resilient valve.

8. A liquid chemical grouting apparatus according to claim 5 wherein said second piston valve is formed with lower lateral holes which are in communication with said longitudinal hole of said second piston valve and spaced apart from said outlet of said third channel, said lower lateral holes of said second piston valve being surrounded by a resilient valve.

9. A liquid chemical injection apparatus according to claim 5 wherein said second piston valve is additionally formed with upper longitudinal holes, whereby when said second piston valve is lowered, said second longitudinal holes are permitted to communicate with said lower discharge holes.

* * * * *